US010264887B2

(12) United States Patent
Rambaldo

(10) Patent No.: US 10,264,887 B2
(45) Date of Patent: Apr. 23, 2019

(54) FOLDING CHAIR

(71) Applicant: Juan Martin Rambaldo, Quilmes (AR)

(72) Inventor: Juan Martin Rambaldo, Quilmes (AR)

( * ) Notice: Subject to any disclaimer, the term of this patent is extended or adjusted under 35 U.S.C. 154(b) by 0 days.

(21) Appl. No.: 15/707,463

(22) Filed: Sep. 18, 2017

(65) Prior Publication Data

US 2018/0000247 A1 Jan. 4, 2018

Related U.S. Application Data

(63) Continuation of application No. PCT/AU2016/050195, filed on Mar. 18, 2016.

(30) Foreign Application Priority Data

Mar. 18, 2015 (AR) ..... 20150100810

(51) Int. Cl.
*A47C 4/20* (2006.01)
*A47C 3/04* (2006.01)
*A47C 4/08* (2006.01)

(52) U.S. Cl.
CPC ..... *A47C 4/20* (2013.01); *A47C 3/04* (2013.01); *A47C 4/08* (2013.01)

(58) Field of Classification Search
CPC .... A47C 4/20; A47C 4/08; A47C 4/10; A47C 4/18; A47C 3/04; A47C 3/045
USPC ..... 297/55
See application file for complete search history.

(56) References Cited

U.S. PATENT DOCUMENTS 1,683,327 A * 9/1928 Bouharoun ..... A47C 4/20 297/35
1,865,139 A * 6/1932 Rastetter ..... A47C 4/10 297/39
2,289,733 A * 7/1942 Rust ..... A47C 1/035 297/90
2,483,309 A * 9/1949 Amaducci ..... A47C 4/10 297/125
2,711,207 A * 6/1955 Roth ..... A47K 11/06 297/40
3,086,812 A * 4/1963 Eads ..... A47D 1/002 297/30
4,529,245 A * 7/1985 Kassai ..... A47D 1/002 297/30
4,792,181 A 12/1988 Guichon
4,890,881 A 1/1990 Ollat et al.
5,037,116 A * 8/1991 Desanta ..... A47C 3/045 297/16.1

(Continued)

FOREIGN PATENT DOCUMENTS

CN 2145545 11/1993
CN 202009867 10/2011

(Continued)

*Primary Examiner* — Mark R Wendell
(74) *Attorney, Agent, or Firm* — Peacock Law P.C.; Janeen Vilven

(57) ABSTRACT

Folding chair with armrests, type S, articulated by transversal axes to the armrests. It has a seat; a back; a horizontal base that is set on the ground; two front legs that join the front part of said seat with the horizontal base that is set to the ground; an attachment mechanism in the application position; two joining bars that articulate the armrests with the middle part of the seat and with the horizontal base that is set to the ground.

5 Claims, 5 Drawing Sheets

(56) References Cited

U.S. PATENT DOCUMENTS

| | | | | |
|---|---|---|---|---|
| 6,471,287 | B1 * | 10/2002 | Liu | A47C 3/029 297/32 |
| 6,511,122 | B1 * | 1/2003 | Chen | A47C 4/10 297/16.2 |
| 6,979,056 | B1 * | 12/2005 | Goldszer | A47C 1/0265 297/184.1 |
| 7,273,249 | B1 * | 9/2007 | Tseng | A47C 4/10 297/16.1 |
| D656,332 | S | 3/2012 | Gibilterra | |
| 2014/0368003 | A1 * | 12/2014 | Squires | A47C 7/744 297/16.2 |
| 2018/0084917 | A1 * | 3/2018 | Weirun | A47C 7/62 |

FOREIGN PATENT DOCUMENTS

| | | |
|---|---|---|
| CN | 202477011 | 10/2012 |
| CN | 203841361 | 9/2014 |
| DE | 328955 | 1/1921 |
| DE | 7247793 | 7/1973 |
| FR | 3000652 | 7/2014 |
| GB | 648075 | 12/1950 |
| GB | 795409 | 5/1958 |
| WO | 2016/145495 | 9/2016 |

* cited by examiner

FOLDING CHAIR

AREA OF TECHNOLOGY

This present invention belongs to folding chairs and armchairs. Especially those that have armrests.

STATE OF THE ART

There is a wide variety of folding chairs and armchairs, such as those described in patents documents CN203841361, CN202477011, CN202009867, CN202086040 ESMU0163879, FR3000652, CN201094416, US48908B1, U.S. Pat. No. 4,792,181, GB795409, among others.

For some time now wood folding chairs with X frame have been very popular and very useful. These chairs are folded by means of scissors joints that hinge the pairs of legs at their midpoint, as you can observe in patent GB648075. The bearing surface with the ground of these chairs type X is only in four points, which makes it less suitable for soft soils such as grass or sand where it will probably dip, you will not have these problems with S frame.

Director's chairs such as those described in patent DE328955A, which have horizontal support bars on the ground and are folded through axes parallel to the armrests.

The typical beach deck chair that uses armrests as folding mechanism and has horizontal bars that are set on the ground, which are perpendicular to said armrests, also constitutes a precedent of this invention.

On the other hand, chairs and armchairs with S shape are very well-known, its support base that is in contact with the ground usually has a sled shape, as it is described in patent DE7247793U or USD656332S. The characteristic of these models is that they make an S between the armrests, back, seat, and a pair of vertical legs that are placed ahead and continue in horizontal bars that are set on the ground and are parallel to the armrests. Lengthwise stability of these chairs is provided by the structural strength of the S, especially in the joint between the seat and the vertical legs placed ahead and the bars that are set on the ground, transversal bars and the back offers resistance to the system in the other sense. Generally, this structural resistance takes place because the S frame is made with continuous material or in one piece.

In spite of the great amount of information related to folding chairs and armchairs, there are neither signs nor suggestions in the state of the technique of a chair that is type S and folding, where the seat, the vertical front legs, and the base set on the ground are jointed.

This present invention provides a folding chair with type S armrests, articulated by means of transversal axes perpendicular to the armrests: two vertical legs that join the front part of the seat with the horizontal base set to the ground; and two joining bars which articulate the armrests with the middle part of the seat and the horizontal base set on the ground.

Moreover, this present invention provides a mechanism that allows setting the folding chair in an application position and a folding structure that allows to hang it, since it forms a corbel that is attached to the wall and is similar to the support used for bikes.

BRIEF DRAWING DESCRIPTION

Figure 4A:
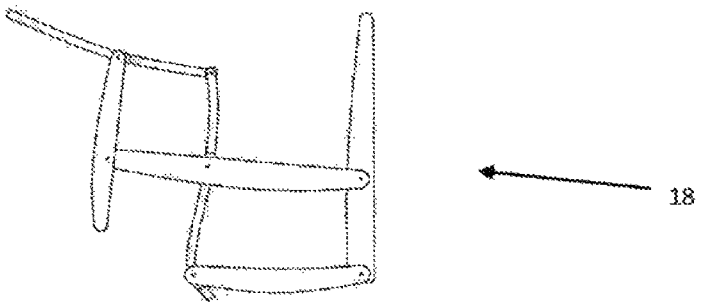
Figure 4B:
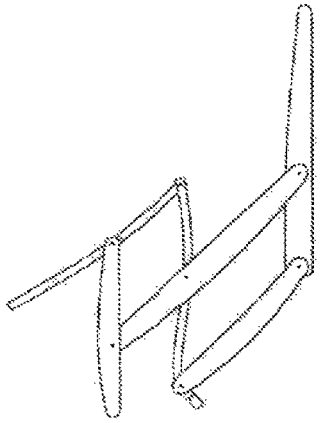
Figure 4C:
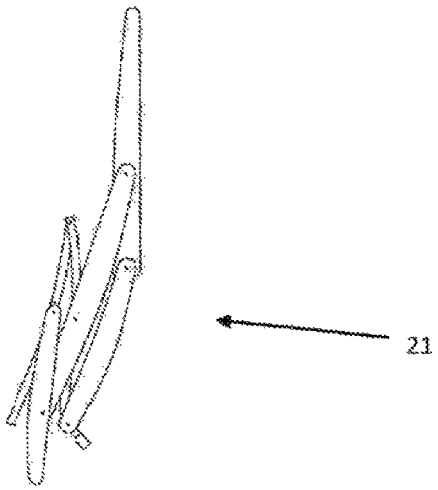

FIG. 4 A-C of this figure shows three positions of the chair: open or in application position, intermediate, and folded.

Figure 5:
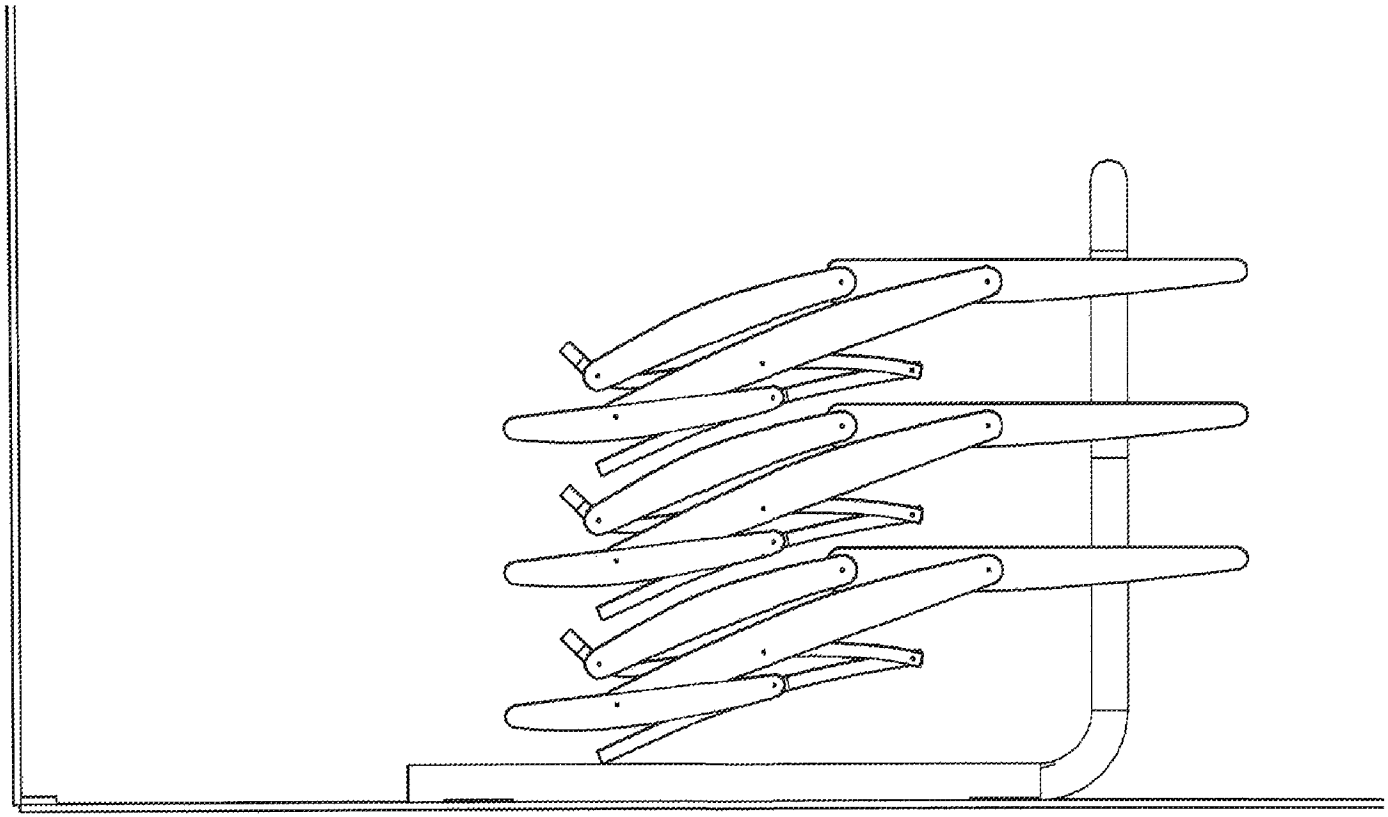

FIG. 5 Shows an image with three chairs of this invention, they are folded and hang from the U support.

GLOSSARY (1) Armrest
(2) Axes transversal to said armrests
(3) Seat
(4) Back
(5) Horizontal base set to the ground
(6) Front legs
(7) Font part of said seat
(8) Attachment mechanism in application position
(9) Joining bars
(10) Parallel bars set to the ground
(11) U support on the ground
(12) Rod
(13) Rail
(14) First perpendicular axis
(15) Hole
(16) Second perpendicular axis
(17) Slot
(18) Application position of the chair
(19) Said rods jointly make an attachment U in application position.
(20) Latch in the armrest
(21) Folded position of the chair

BRIEF DESCRIPTION OF THE INVENTION

The folding chair with armrests (1), type S, articulated by transversal axes to said armrests (2), main object of this invention, has a seat (3); a back (4); a horizontal base that sets on the ground (5); two front legs (6), preferably vertical in its application position, that join the front part with said seat (7) with said horizontal base that sets on the ground; an attachment mechanism in the application position (8); and two joining bars (9) that articulate the armrests with the middle part of said horizontal base that sets on the ground; where said joining bars are preferably vertical in the application position.

Besides, said horizontal base that sets on the ground shows different preferred embodiments for this present invention, such as:

Two parallel bars (10) to said armrests.

A support U (11) that is articulated in its ends with the front legs. The base of the U is the support area that enables to hang the chair in the folded position.

A plain surface with articulation with the front legs and the joining bars.

Among other possible alternatives.

Besides, this present invention solves the technical problem of attaching the chair when it is opened in the application position through an attachment mechanism that has a rod (12) with two perpendicular axes (both to the rod and to the armrest) in its ends and a rail (13) jointly joined to the base of the seat. A first perpendicular axis (14) is inserted in a hole (15) of the front leg, and a second perpendicular axis (16) slots into said rail. Where the rail becomes wider downwards making up a slot (17), the second perpendicular axis slots into in the application position (18) of said chair, and where the first perpendicular axis allows the free turn of the rod, located in the hole of the front leg.

In a preferred embodiment said attachment mechanism in the application position has two of said rods in each side of the chair and two rails. In addition, said attachment mechanism in the application use has a second and only perpendicular axis that joins the two rods and jointly make an attachment U (19), which is handled from the sides of the chair and its width is slightly smaller than the width of the seat.

In a preferred embodiment of this invention, said attachment mechanism in the application position also has a latch (20) in the armrest that abuts against said joining bar, which limits the movement of the chair backwards.

DETAILED DESCRIPTION OF THE INVENTION

This invention is made up of a folding type S chair, with armrests (1), articulated by transversal axes (2), it has: two front legs (6) that join the front part of the seat (7) with the horizontal base set to the ground (5); and two joining bars (9) that join the armrests (1) with the middle part of the seat (3) and the horizontal base set to the ground.

In addition, this invention has an attachment mechanism in the application position (8) that allows to set the folding chair in an opened position. This mechanism has, in a preferred embodiment, a tough U shape rod that is joined with the front legs through both axes placed in the ends of the U, which are inserted in holes made in the front legs. The base of the U is a straight line that is slightly smaller to the width of the seat and slides in both rails. These rails are parallel to the armrests, and are jointly joined to the lower part of the seat in its sides and have a slot that widens downwards of the rail, where the rod slots into the rail in the opened position of the chair. This mechanism limits the movement of the chair backwards and forwards. The rod, which can be metallic and circular sections, and with U shape, can be activated in both sides of the chair.

The rod is in a slot that stops its movement and attaches the front legs in the best angle of approximately 90° when the chair is opened.

Besides, the attachment mechanism in the application position can have a block or latch (20) in the armrests to limit the movement of the joining bars.

This invention includes attachment mechanisms similar to those previously described accomplishing the same functions that are described in this document This invention is not only new, since it has not been disclosed before, but also it shows inventive action, since there are no records that suggest or determine the existence of the structure and the attachment mechanism that were invented. Once this new technical problem is defined, attaching the chair defined by its structural characteristics, it would be possible to use another attachment system, among those known in the state of the art to attach the chair in its opened application position.

The horizontal base that sets on the ground, in a preferred embodiment, of this invention, is made up of two bars parallel to the armrests that are placed longitudinally on both sides of the chair, making a sled type structure. The two bars are joined, in a preferred embodiment, jointly with a wide rung in the back end of same especially designed to avoid the base to move out from the square with use. Another alternative would be to use two rungs that make up a square base. Another option would be to use a horizontal sheet or plate articulated with both front legs and with joining bars.

Images show how the chair is folded, profile with S shape through an articulation system with transversal axes without rails that join all its parts: the seat, the back, the armrests, the joining bars, the support base and the legs, making up a grid with several scissors and axes that work simultaneously. Rails are not used in the joints in order to strengthen the system.

Figure 1:
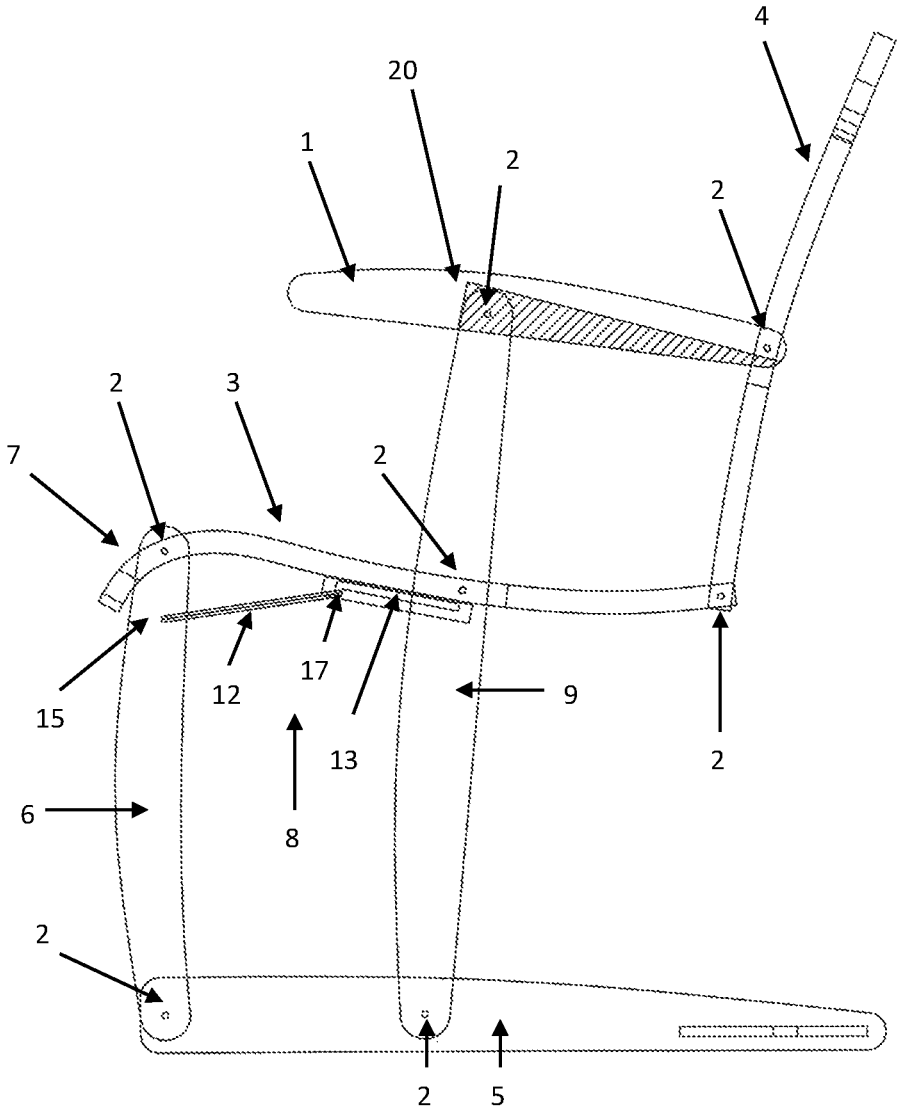
FIG. 1 Shows a lateral view of the chair of this invention opened for its use FIG. 2 Shows a perspective without seat nor back, the attachment mechanism in application position and the U support can be observed in more detail.
Figure 2:
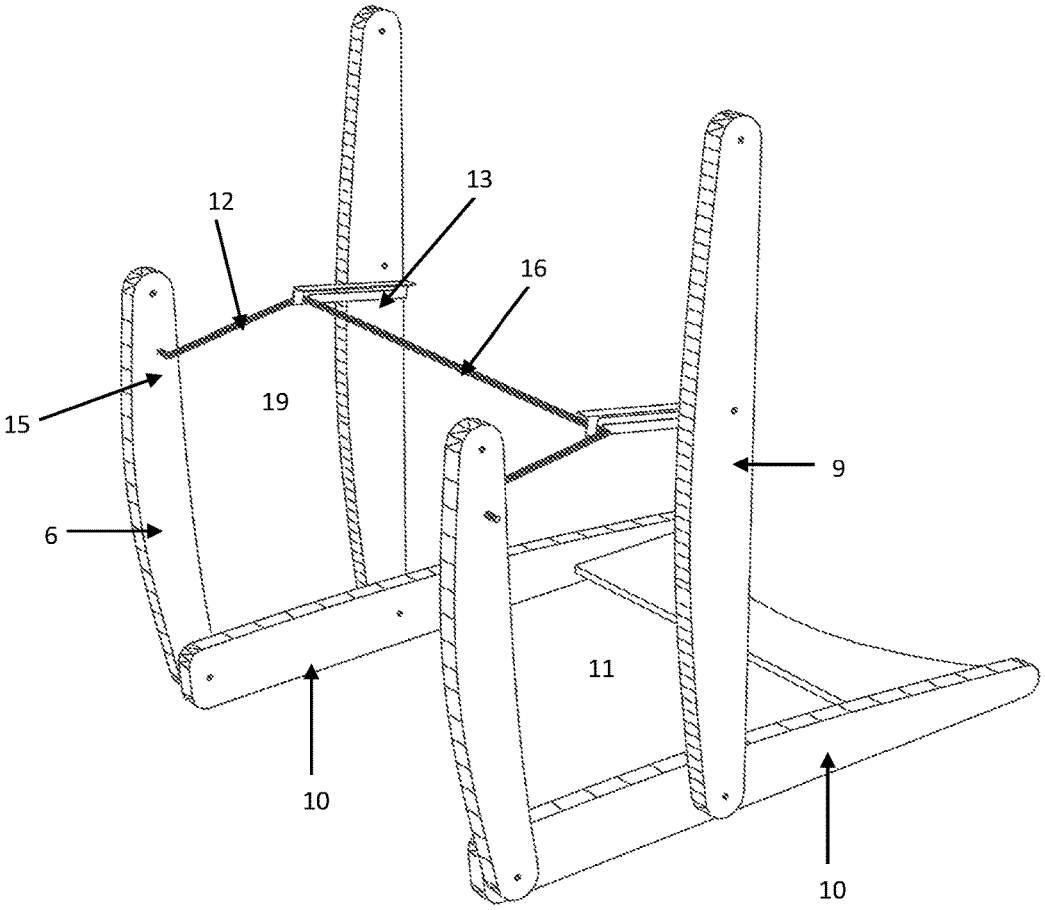

This chair cannot be manufactured without armrests, as it is the case of other traditional folding chairs that are manufactured with or without armrests, since they keep the back together with the transversal axes that is placed between the seat and the back. The armrests, in a preferred embodiment, have slots where the joining bars are partially hidden when the chair is folded in order to reduce the size of the folded chair and to avoid injuries in hands with movement. Therefore, the transversal section of armrests have an inverted U shape, which can contain the head of the joining bars and blocks to limit the turn of said heads. This is observed in FIG. 1 in the shaded part of the armrest.

The seat and the back can be made, among many alternatives, with press laminating in matrixes with curve shapes suitable for its use that requires anatomical forms and cut with comb shape with CNC router so that these parts can be folded in its intersection. The rest of the parts, that is to say; legs, armrests, joining bars, and rungs can be manufactured, among other options, with hardwood cut with saw or shaper.

Other material and systems can be used when manufacturing this chair, such as fiberglass, with the corresponding matrixes; aluminum, using molds for the melting of the back and the seat with aluminum pipes in the legs; or vacuum forming plastics or rotomolding, etc. These parts are assembled with metallic transversal axes, which could be clinched or screwed; the rung can be joined to the support bars, which are the base set to the ground, through a simple system of box joint.

The closed chair is hung inverted to the rung that joins the two support bars (this rung is the base of the support U) a support attached in a wall similar to the bicycle support built with a bent metallic pipe. This system enables to put several folded chairs in limited spaces.

APPLICATION EXAMPLES

This chair has several parts that are manufactured using different technologies.

Figure 3:
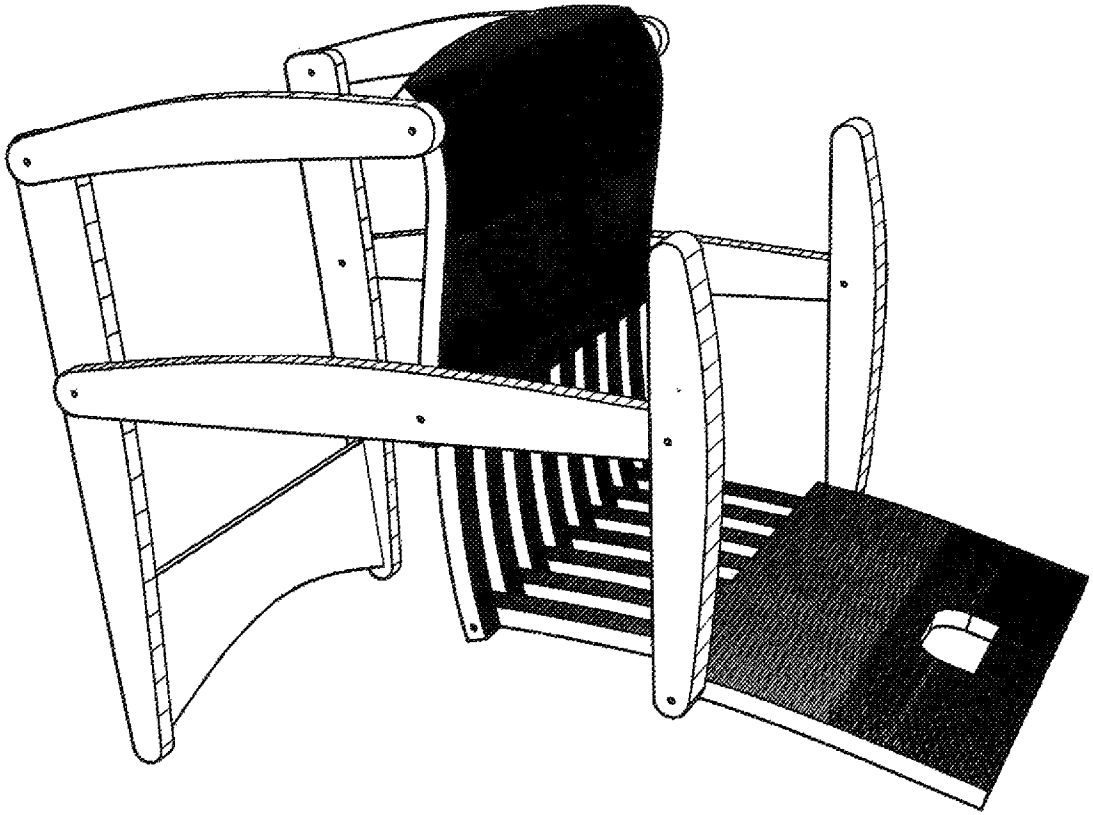
FIG. 3 Shows a perspective of a possible embodiment. The attachment mechanism cannot be seen.

The seat and the back are manufactured with plywood, laminated sheets of wood stuck with each other and are pressed in matrixes that have the corresponding anatomical shape. The top and lower face of these parts are covered with more attractive sheets of wood in order to improve their appearance, inside the laminating cheaper sheets of wood are used, such as pine. When the board is dry it is cut through a CNC router that cuts both its perimeter and the comb placed in the joint of the two parts. In FIG. 3 you can observe the shape of the back that shows a comb in its lower part and a full support in the top part. The same comb is repeated in the seat. Although the shape of the comb that affects the seat and the back are correct for a suitable ventilation of the user's body and the comb enables the user to lean his back along the entire length, it is actually ornamental and it is not essential for the chair to work properly. Therefore, these elements can have other shapes, for instance: a back with inverted U shape with arms joined to the seat or with M shape with three arms depending on the designer's taste. The rung that completes the support U, on the support base on the ground, is also made with a plywood that has approximately half the thickness of the seat and cut with CNC router so that it has the correct shape.

The legs, armrests and joining bars are produced with hardwood and cut with shaper or CNC router. The armrests have a slot with inverted U shape where the joining bars are partially hidden and have a block or latch to avoid an excessive opening of the chair.

These elements are joined through metallic axes perpendicular to the armrests, which are clinched and articulate the mobile parts, except for the rung in the support U that is attached to the support base set on the ground through a box joint assembly. A long metallic transversal axis goes through all combs and joins the seat with the back.

Finally, the chair is completed by installing a metallic latch with an axis with U shape that has the same width as the seat attached to the legs and rails attached longitudinally in the ends of the inferior part of the seat through screws. Said rails have slots, where the moveable axis falls or is pushed through a spring immobilizing the chair in the correct position. The length of the rail is determined by the opening angle of the chair and is approximately a quarter of the seat's depth. The final finishing of the chair can be varnished, polished or painted.

The invention claimed is:

1. A folding chair configurable between a position of use and a folded position, with armrests and four cantilever legs articulated by transversal axes to said armrests, comprising:

a seat;

a back;

a horizontal support base that is set to the ground; and a releasable mechanism to lock the chair in the position of use;

the four cantilever legs comprising:

two front legs, each being positioned on respective sides of the chair, and directly engaged with a front end portion of the seat and a front portion of the horizontal support base by way of pivotable engagement; and two rear legs, each being positioned on respective sides of the chair, and directly engaged with the armrests, the middle part of the seat and the horizontal support base by way of pivotable engagement;

wherein the releasable mechanism to lock the chair in the position of use comprises two rods positioned in each side of the chair joining the axes, perpendicular to the armrests, placed in the middle of the front legs to the middle part of the seat;

the four cantilever legs are parallel with one another in the position of use, the folded position and during a transition therebetween; and the armrests and the horizontal support base are parallel with one another in the position of use, in the folded position and during the transition therebetween.

2. The folding chair of claim 1 wherein the two front legs are vertical in the position of use.

3. The folding chair of claim 1 wherein the two back legs are vertical in the position of use.

4. The folding chair of claim 1 wherein the seat is comb shaped and is joined to the back at the end of the teeth of the comb by axes in both sides, perpendicular to the armrests.

5. The folding chair of claim 1 wherein the armrests, back, seat, front legs and horizontal support base are connected such that they collectively form an 'S' shape.

* * * * *